United States Patent [19]

Jöbkes

[11] 4,140,284

[45] Feb. 20, 1979

[54] IMPACT CRUSHER

[75] Inventor: Jakob Jöbkes, Münster, Fed. Rep. of Germany

[73] Assignee: Hazemag Dr. E. Andreas GmbH & Co., Münster, Fed. Rep. of Germany

[21] Appl. No.: 835,855

[22] Filed: Sep. 20, 1977

Related U.S. Application Data

[63] Continuation of Ser. No. 723,044, Sep. 13, 1977, abandoned.

[30] Foreign Application Priority Data

Sep. 15, 1975 [DE] Fed. Rep. of Germany ..... 2541036

[51] Int. Cl.[2] ..... B02C 13/282

[52] U.S. Cl. ..... 241/189 R; 241/241

[58] Field of Search ..... 241/189 R, 189 A, 239–241

[56] References Cited

U.S. PATENT DOCUMENTS

| | | | |
|---|---|---|---|
| 3,083,921 | 4/1963 | Danyluke et al. | 241/240 X |
| 3,343,800 | 9/1967 | Rasmussen | 241/189 R X |
| 3,447,758 | 6/1969 | Oznobichine | 241/189 R X |
| 3,659,794 | 5/1972 | Hemesath | 241/189 R |
| 4,017,035 | 4/1977 | Stuttmann | 241/189 R |

FOREIGN PATENT DOCUMENTS

| | | | |
|---|---|---|---|
| 2311431 | 9/1974 | Fed. Rep. of Germany | 241/189 R |
| 2331729 | 1/1975 | Fed. Rep. of Germany | 241/189 R |

*Primary Examiner*—Howard N. Goldberg
*Attorney, Agent, or Firm*—Michael J. Striker

[57] ABSTRACT

An impact crusher has a housing; a rotor mounted in the housing for rotation in a predetermined direction about a substantially horizontal axis; a charging opening in the housing above the rotor and at one side of the axis at which the rotation of the rotor is in upward direction; impact plate arrangement at the other side of the axis at which the rotation of the rotor is in downward direction so that material admitted through the opening and falling onto the rotor is flung against the plate arrangement, the plate arrangement comprising a first impact plate at a level higher than the rotor and a second plate spaced from the first plate in the predetermined direction, each plate having an impact surface facing generally opposite to said direction; and arrangement for displacing said first plate to and from a position in which the impact surface of the first plate is proximal to and constitutes an extension of the first impact surface of the second plate.

7 Claims, 1 Drawing Figure

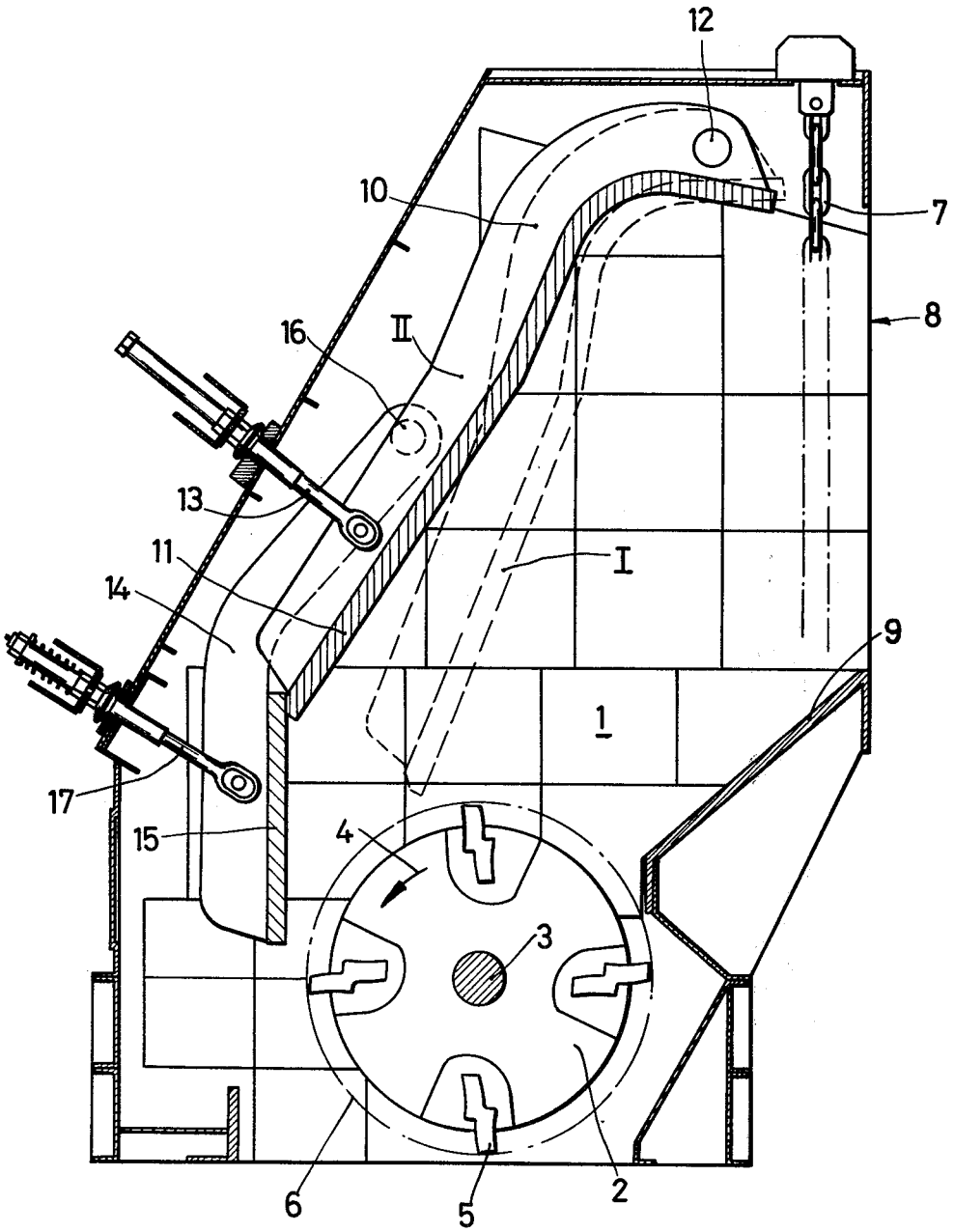
12
10
7
8
16
II
13
11
I
14
9
1
17
15
4
3
6
5
2

IMPACT CRUSHER

This is a continuation of application Ser. No. 723,044, filed Sept. 13, 1977, now abandoned.

BACKGROUND OF THE INVENTION

This invention relates to an impact crusher or impact mill. More particularly, it relates to a multipurpose impact crusher.

Impact crushers per se are known. They operate on the principle that material to be crushed is dropped from above onto a rotor which turns about a horizontal axis and is provided with a plurality of beater bars projecting from its circumference. The beater bars hit the material and fling it against two or more impact members which are appropriately positioned for this purpose. Upon impacting the respective impact member the material may fall back upon the rotor to be hit again by the beater bars of the same.

These impact crushers are highly effective for many different kinds of materials, for example, ores as well as solid refuse.

As a general rule the presence of two or more impact members spaced from one another in the direction of rotation of the rotor provides for excellent crushing results. However, it has been found that some material can be crushed most effectively if, instead of the separate impact surfaces of two or more impact members, a single impact surface is provided which bounds a relatively large impact space adjacent the rotor and in part extends about the rotor coextensive with the rotational direction thereof.

SUMMARY OF THE INVENTION

As these two conflicting requirements cannot be met by the known impact crushers, it is a general object of the invention to overcome the prior-art drawbacks.

More particularly, it is an object of the invention to provide an improved impact crusher of the type in question, which permits the most effective crushing of all types of materials, irrespective of whether or not they can be crushed best by being flung against only a single or against a plurality of impact surfaces.

Still more particularly, it is an object of the invention to provide an improved impact crusher which can be quickly and readily adjusted to provide the particular crushing action which is most effective with a particular kind of material.

In keeping with these objects and with others which will become apparent hereafter, one feature of the invention resides in an impact crusher which, briefly stated, comprises a housing; a rotor mounted in the housing for rotation in a predetermined direction about a substantially horizontal axis; a charging opening in the housing above the rotor and at one side of the axis at which the rotation of the rotor is in upward direction; impact plate means above the rotor and at the other side of the axis at which the rotation of the rotor is in downward direction so that material admitted through the opening and falling onto the rotor is flung against the plate means, the plate means comprising a first impact plate at a level higher than the rotor and a second plate spaced from the first plate in the predetermined direction, each plate having an impact surface facing generally opposite to the direction; and means for displacing the first plate to and from a position in which the impact surface of the first plate is proximal to and constitutes an extension of the impact surface of the second plate.

The novel impact crusher makes it possible to crush materials in the manner that is most effective with the particular kind of material. By moving the impact plates to a position in which their impact surfaces each constitute an extension of the other, a single continuous impact surface is obtained which provides best results when crushing some types of materials. Conversely, moving the impact plates to the other position in which their impact surfaces are spaced from one another and act separately from each other, other types of materials can be most effectively crushed since now the impact plates operate independently and cooperate sequentially with the rotor, in that their lower (i.e. downstream as seen with reference to the direction of rotation of the rotor) ends extend close to the circle swept by the beaters of the rotor at respective locations which are spaced from one another in said direction of rotation.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

BRIEF DESCRIPTION OF THE DRAWING

The single FIGURE is a somewhat diagrammatic, fragmentary vertical section through an impact crusher embodying the invention.

DESCRIPTION OF THE PREFERRED EMBODIMENT

The crusher has a housing 1 in which a rotor 2 is mounted on a shaft 3 for rotation in the direction of arrow 4 about a horizontal axis.

The circumference of rotor 3 is provided with beater bars 5 having outer edges which sweep or orbit through the air in a circle 6 when the rotor 2 turns. The material-admitting inlet 8 to the crushing chamber is located above the rotor 2 and at that side of the shaft 3 at which the beater bars 5 move in upward direction, i.e. in the rising quadrant of movement of the rotor 2. A curtain 7 of chains or the like extends across the inlet 8 and permits the admission of material from outside but intercepts articles or pieces thereof which are being flung about the crushing chamber and attempt to escape through the inlet. A chute or other arrangement 9 directs admitted material onto the rotor 2.

The impact plates are provided adjacent the upper descending quadrant of movement of the rotor, i.e., at the side of shaft 3 opposite to the side where inlet 8 is located. They comprise a first impact plate (the term is used broadly throughout to define an impact member of desired configuration) 10 which is located at a level higher than the second impact plate 14. Plate 10 has an impact surface 11 and is tiltably mounted on a pivot 12. It is advantageous if the distance between the pivot 12 and the circle 6 swept by the beater bars 5 of rotor 2 is spaced upwardly of the rotor by a distance which is equal to at least twice the diameter of this circle; the distance may also be greater, e.g. a different multiple. Such a construction has the advantage that the angle through which the plate 10 must be pivoted to travel between its two end positions (these will be discussed later) is relatively small and that the impact surface 11 will in both positions be located at an advantageous angle relative to the direction of impact of the material. It is also advantageous if at least the longer, lower portion of the impact surface extends in a direction which intersects a horizontal plane passing through the pivot axis defined by pivot 12, the point of intersection being spaced from the pivot 12 and located at that side of the pivot which is opposite to the inlet 8. This is illustrated in the FIGURE.

Spindles 13, known from the art, engage plate 10 and arrest it in desired positions, labelled I and II in the FIGURE. It is also mounted — in a manner known from the art — so that it can yield somewhat when it is hit by large uncrushable articles.

The second impact plate 14 is mounted so as to be spaced from plate 10 in the direction of rotation (arrow 4) of the rotor 2. Plate 14 has an impact surface 15 and is mounted on a pivot 16 for tilting about a pivot axis defined by this pivot. Spindles 17, similar to spindles 13, hold plate 14 in its illustrated working position in which the lower end portion of its impact surface 15 extends near to the circle swept by the beater bars 5. Plate 14 can yield somewhat when impacted by a large article as described above with reference to plate 10.

When plate 10 is in position I (the broken lines) the lower end portion of its impact surface extends near to the circle swept by the beater bars 5, in the vicinity of the apex of this circle. This lower end portion is then spaced from impact surface 15 of plate 14 and the two plates 10, 14 operate independently and sequentially, i.e. material is flung by rotor 2 first against plate 10, falls back onto rotor 2 and is then flung against plate 14.

When plate 10 is moved to position II (shown in solid lines) the lower end portion of its surface 11 is located proximal to the upper end of surface 15 (the lower end of plate 10 may abut or be very close to the surface 15), so that surfaces 11 and 15 in effect constitute a single compound impact surface for use in crushing of material which responds better to the presence of such a single surface than to the presence of two or more separately acting surfaces.

When plate 10 is in position II the lower end of its surface 11 is relatively far distant from the circle swept by beater bars 5. Therefore, it need not absolutely be capable of yielding outwardly when impacted by large articles or objects. However, in the illustrated embodiment it is, in fact, capable of yielding slightly in outward direction beyond position II whenever the plate 14 itself performs such a movement.

Crushed material falls out of the housing 1 through the outlet beneath the rotor 2.

It will be understood that each of the elements described above, or two or more together, may also find a useful application in other types of applications differing from the types described above.

While the invention has been illustrated and described as embodied in an impact crusher, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an impact crusher, a combination comprising a housing having an interior; a rotor mounted in said interior for rotation about a substantially horizontal axis; a charging opening in said housing above said rotor and at one side of said axis at which the rotation of said rotor is in upward direction, so that material admitted through said opening drops onto said rotor; and impact plate means against which admitted material is flung by said rotor, including a first impact plate bounded by a lower edge which is located at the other side of said axis at which the rotation of said rotor is in downward direction, a second impact plate located at said other side and having an upper edge portion and a lower edge portion which is at a level lower than said lower edge of said first impact plate, and means for displacing said first impact plate relative to said second impact plate between one position in which said lower edge of said first impact plate is closer to said one side and farther from said upper edge portion so that said first and second impact plates divide said interior into two chambers in which the material sequentially impacts said first and second impact plates individually and thus undergoes a more intensive crushing action, and another position in which said lower edge of said first impact plate is farther spaced from said one side and proximal to said upper edge portion so that said first and second impact plates form in said interior a single chamber and together form a single large impact surface to be impacted by the material which thus undergoes a less intensive crushing action.

2. A combination as defined in claim 1, wherein said displacing means comprises positioning means for positioning said first impact plate in said positions.

3. A combination as defined in claim 1, said displacing means comprising pivot means mounting said first impact plate for pivotal displacement about its upper end.

4. A combination as defined in claim 3, said pivot means being located upwardly spaced from said rotor by a distance which is equal to a multiple of the diameter of the circle swept by the rotor.

5. The combination defined in claim 4, wherein said multiple is equal to at least two times said diameter.

6. A combination as defined in claim 3, wherein the general plane of the lower portion of said first impact plate intersects a horizontal plane passing through the axis of said pivot means, in a point of intersection which is further spaced from said charging opening than is the axis of said pivot means.

7. In an impact crusher, a combination comprising a housing having an interior; a rotor mounted in said interior for rotation about a substantially horizontal axis; a charging opening in said housing above said rotor and at one side of said axis at which the rotation of said rotor is in upward direction, so that material admitted through said opening drops onto said rotor; and impact plate means against which admitted material is flung by said rotor, including a first impact plate extending from above the rotor downwards and having a lower edge, and a second impact plate located at the side of said axis at which the rotation of said rotor is in downward direction and extending substantially downwards, said second impact plate having a lower edge defining a gap with the circle swept by the rotor at said other side of said axis, and means for displacing said first impact plate relative to said second impact plate between one position in which said lower edge of the first impact plate defines with the circle swept by the rotor a gap in the vicinity of the highest point of the circle so that said first impact plate divides the space between said second impact plate and said charging opening into two impact chambers in which the material sequentially impacts said first and second impact plates and thus undergoes a more intensive crushing action, and another position in which said lower edge of said first impact plate is proximal to the upper portion of said second impact plate so that said first and second impact plates together border a single impact chamber and form a single large impact surface so that the material undergoes a less intensive crushing action.

* * * * *